US005208928A

United States Patent [19]

Kuck et al.

[11] Patent Number: 5,208,928

[45] Date of Patent: May 11, 1993

[54] PLASTIC SURGERY TABLE

[75] Inventors: Jay L. Kuck, St. Marys; Keith A. Stickley, Greenville, both of Ohio; Terry J. Simpkins, Sr.; Terry J. Simpkins, Jr., both of Carlsbad, Calif.

[73] Assignee: Midmark Corporation, Versailles, Ohio

[21] Appl. No.: 763,197

[22] Filed: Sep. 20, 1991

[51] Int. Cl.[5] ..... A61G 7/00

[52] U.S. Cl. ..... 5/608; 5/610; 5/611; 5/621; 5/622

[58] Field of Search ..... 5/600, 607, 608, 610, 5/611, 613, 616, 621, 622, 630, 640; 108/147

[56] References Cited

U.S. PATENT DOCUMENTS

| | | | |
|---|---|---|---|
| 322,437 | 7/1885 | Gaston . | |
| 1,185,054 | 5/1916 | Buekley | 5/607 |
| 1,740,906 | 12/1929 | Rothauszky et al. . | |
| 3,131,301 | 4/1964 | Barrett et al. | 250/55 |
| 3,188,079 | 6/1965 | Boetcker et al. | 5/622 |
| 3,289,074 | 12/1966 | Platt | 5/622 X |
| 3,339,913 | 9/1967 | Anderson | 5/600 |
| 3,525,308 | 8/1970 | Koopmans | 108/8 |
| 3,572,835 | 3/1971 | Kees, Jr. | 5/640 X |
| 3,820,176 | 6/1974 | Feiertag | 5/611 |
| 4,254,928 | 3/1981 | Huempfner et al. | 5/611 X |
| 4,409,695 | 10/1983 | Johnston et al. | 5/616 X |
| 4,552,403 | 11/1985 | Yindra | 108/147 X |
| 4,618,133 | 10/1986 | Siczek | 269/323 |
| 4,669,136 | 6/1987 | Waters et al. | 5/611 X |
| 4,685,159 | 8/1987 | Oetiker | 5/611 X |
| 4,749,177 | 6/1988 | Schafer et al. | 5/611 X |
| 4,882,797 | 11/1989 | Failor et al. | 5/613 |
| 4,920,589 | 5/1990 | LaVelle et al. | 5/607 |
| 4,947,496 | 8/1990 | Connolly | 5/622 |
| 5,018,712 | 5/1991 | Schaefer | 269/323 |
| 5,020,170 | 6/1991 | Ruf | 5/607 |

*Primary Examiner*—Michael F. Trettel
*Attorney, Agent, or Firm*—Biebel & French

[57] ABSTRACT

A surgery table is provided in which a patient support portion may be tilted about a longitudinal and a lateral axis and in which torso and leg supporting portions of the table may be pivoted relative to a trunk supporting portion. A new headrest locking mechanism is disclosed whereby supporting ball and socket connections for the headrest may be locked in position with a minimum of applied torque force. In addition, a lift mechanism incorporating telescoping members is provided whereby a large variation in table height may be obtained.

29 Claims, 9 Drawing Sheets

20
16
106
254
222
228
228
252
244
234
230
243
260
224
234
246
250
230
256
236
238
258
248
236
226
262
236
242
232
240

PLASTIC SURGERY TABLE

BACKGROUND OF THE INVENTION

The present invention relates to a surgery table and, more particularly, to a plastic surgery table which may be adjusted.

Surgery tables, such as those used by plastic surgeons, must provide for a variety of adjustments whereby patients may be oriented in an optimum position for the particular surgery being performed. For example, during facial reconstruction surgery, the patient must be positioned such that the surgeon can view the patient from a point aligned with the longitudinal axis of the patient in order to permit the surgeon to maintain symmetry between the opposing sides of the patient's face during the operation.

In order to provide the necessary flexibility in positioning the patient, it is preferable to have a patient support table which is capable of movement about at least two rotational axes, provides for a height adjustment and which allows the patient's legs and torso to be adjusted relative to the patient's trunk, and which further provides for flexible adjustment of the patient head support. In addition, such tables require a height adjustment mechanism in order to allow a patient to easily mount the table as well as to position the table at a convenient height for the surgeon.

Prior art patient support tables have typically provided only a few degrees of adjustment and have not taken into consideration the particular needs associated with plastic surgery. For example, U.S. Pat. No. 322,437 to Gaston discloses an adjustable embalming table which may be pivoted about a longitudinal axis and which provides a certain degree of end to end height adjustment as well as an adjustable head rest. The rotational axis of the table disclosed by Gaston is located below the table surface such that if a person were laying on the table they would feel a high degree of instability as the table is rotated, which is unacceptable for a surgery table. Further, Gaston does not disclose any means for preventing the person from displacing laterally other than straps, which straps would be uncomfortable for a patient and undesirable during plastic surgery operations.

U.S. Pat. No. 5,018,712 Schaefer discloses a patient support including means for supporting a plate for rotation about a longitudinal axis located above the plate wherein the rotational axis moves during rotation of the plate. This device must be formed as a relatively wide structure in order to provide sufficient movement for the guide members which support the plate for movement. Further, a wide base area is required to provide the necessary lateral support for each of the guide members. Such a construction would not be easily adapted to the needs of a plastic surgery table in which a height adjustment mechanism must also be provided.

Accordingly, there is a need for a plastic surgery table which may be pivoted about a longitudinal axis located above the table, and preferably passing through the patient, in order to avoid patient discomfort during rotation of the table and to ensure that the patient is pivoted in such a manner as to not vary the position of the patient in a lateral direction relative to a support base, which may hinder access of a surgeon to the patient.

Further, there is a need for a surgery table in which the table may also be rotated about a lateral axis and in which various components of the patient supporting surface may be adjusted to provide appropriate support for the patient. There is also need for a plastic surgery table in which the base portion of the table below the patient support surface is formed as a compact mechanism providing a wide range of height adjustments for the table.

SUMMARY OF THE INVENTION

A plastic surgery table is provided for supporting a patient in a plurality of positions. The table includes a base portion forming a floor engaging support for the table, a support portion for supporting a patient lying in a substantially supine position, track means located below the support portion and having an arcuate shape with a center of curvature located above the support portion and bearing means located on the base portion for engaging and supporting the track for movement about a pivot axis passing through the center of curvature of the track and parallel to a longitudinal axis of the table.

The support portion preferably includes a first section for supporting a trunk portion of a patient, a second section pivotally mounted to the first section for supporting a torso portion of the patient and a third section pivotally mounted to the first section, opposite from the second section, for supporting a leg portion of a patient. The second and third sections of the support portion are moved relative to the first section by means of motor driven linear actuators.

A support base is provided below and engaged with the track means. The support base attaches the support portion to the base portion and includes a pivot defining a lateral pivot axis for the support portion. The bearing means are mounted on the support base such that the track means pivot along with the support portion during the pivotal movement of the support portion about the lateral axis.

The table is further provided with means for adjusting the height of the support portion including first, second and third post members positioned in telescoping relationship to each other wherein vertical movement of the support portion is effected through movement of the first and second post members relative to the third post member. The post members form a compact pedestal structure for supporting the patient support portion while also providing for a large degree of vertical movement for the patient support portion from its lowest to its highest position such that patients are easily able to mount the table and the table also provides a convenient height for operating.

A plurality of side pads are provided along the lateral edges of the table in order to provide lateral support for the patient as the table is pivoted around its longitudinal axis. The side pads may be positioned parallel to the first, second and third sections of the support portion or they may be pivoted upwardly to predetermined positions in order to increase the lateral support to the patient as the table is rotated about the longitudinal axis. In addition, the side pads may be removed in order to permit closer access to the patient at the lateral edges of the table.

Finally, an adjustable headrest is provided adjacent to an end of the second torso supporting section of the support portion. The headrest is provided with a pair of ball and socket connections connecting a head support pad to the second section of the table such that the head support pad may be located in an infinite number of positions. The headrest is provided with an actuating mechanism to lock the ball and socket connections in position with a minimum of effort while positively limiting the movement of the headrest pad.

Therefore, it is an object of the present invention to provide a plastic surgery table in which a patient support portion may be rotated about a longitudinal axis located above the patient support portion as well as about a lateral axis. It is also an object of the invention to provide such a table wherein leg supporting and torso supporting sections may be pivoted relative to a trunk supporting section.

It is a further object of the invention to provide a surgery table in which a compact mechanism is provided for pivoting the table about a longitudinal axis.

It is another object of the invention to provide a surgery table having a compact pedestal structure for providing a large degree of vertical movement for a patient supporting portion of the table.

It is also an object of the invention to provide a headrest which may be located in a variety of positions.

DETAILED DESCRIPTION OF THE PREFERRED EMBODIMENT

Figure 1:
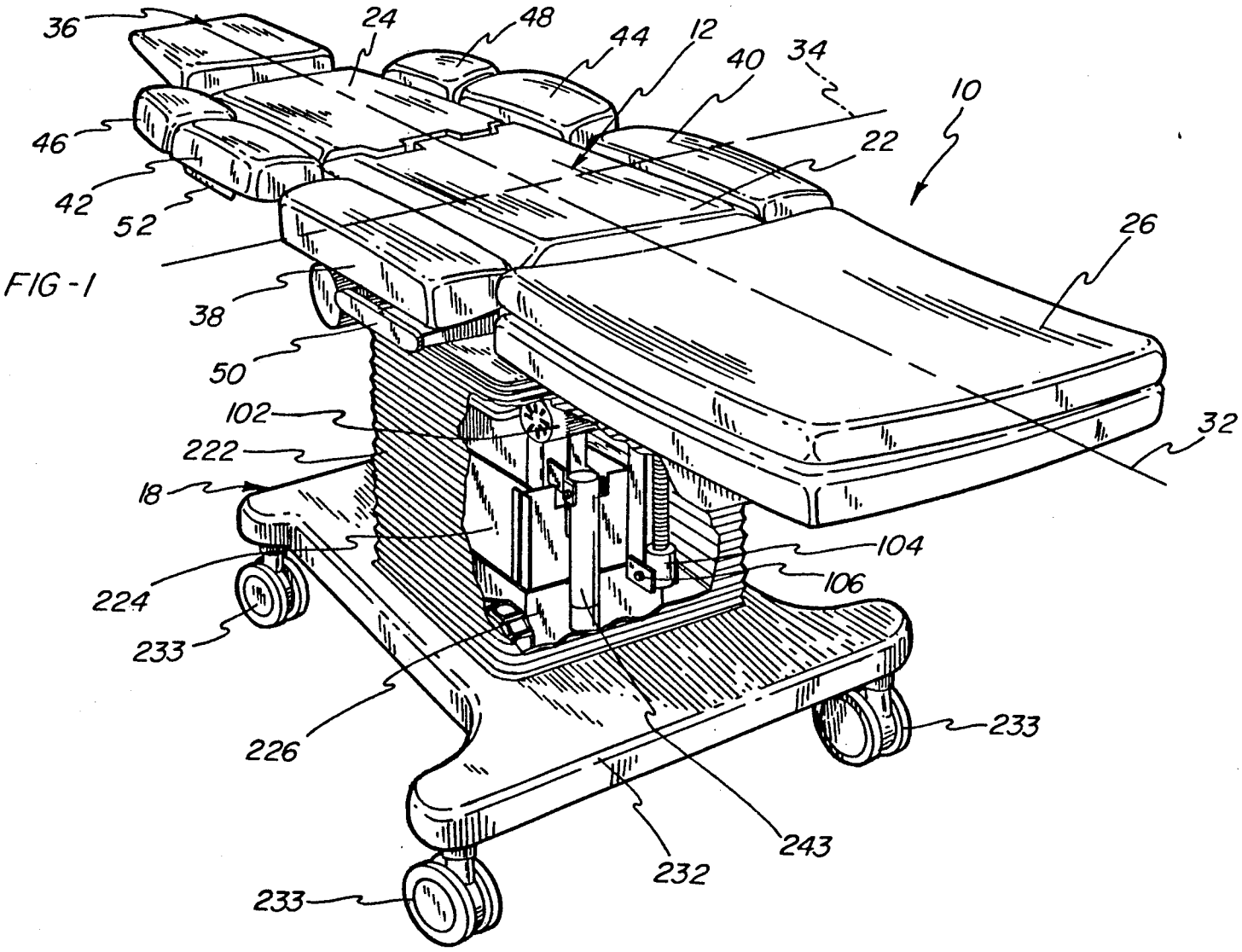
FIG. 1 is a perspective view of the plastic surgery table in which a flexible sleeve element has been cut away to show components of the base portion.
Figure 2:
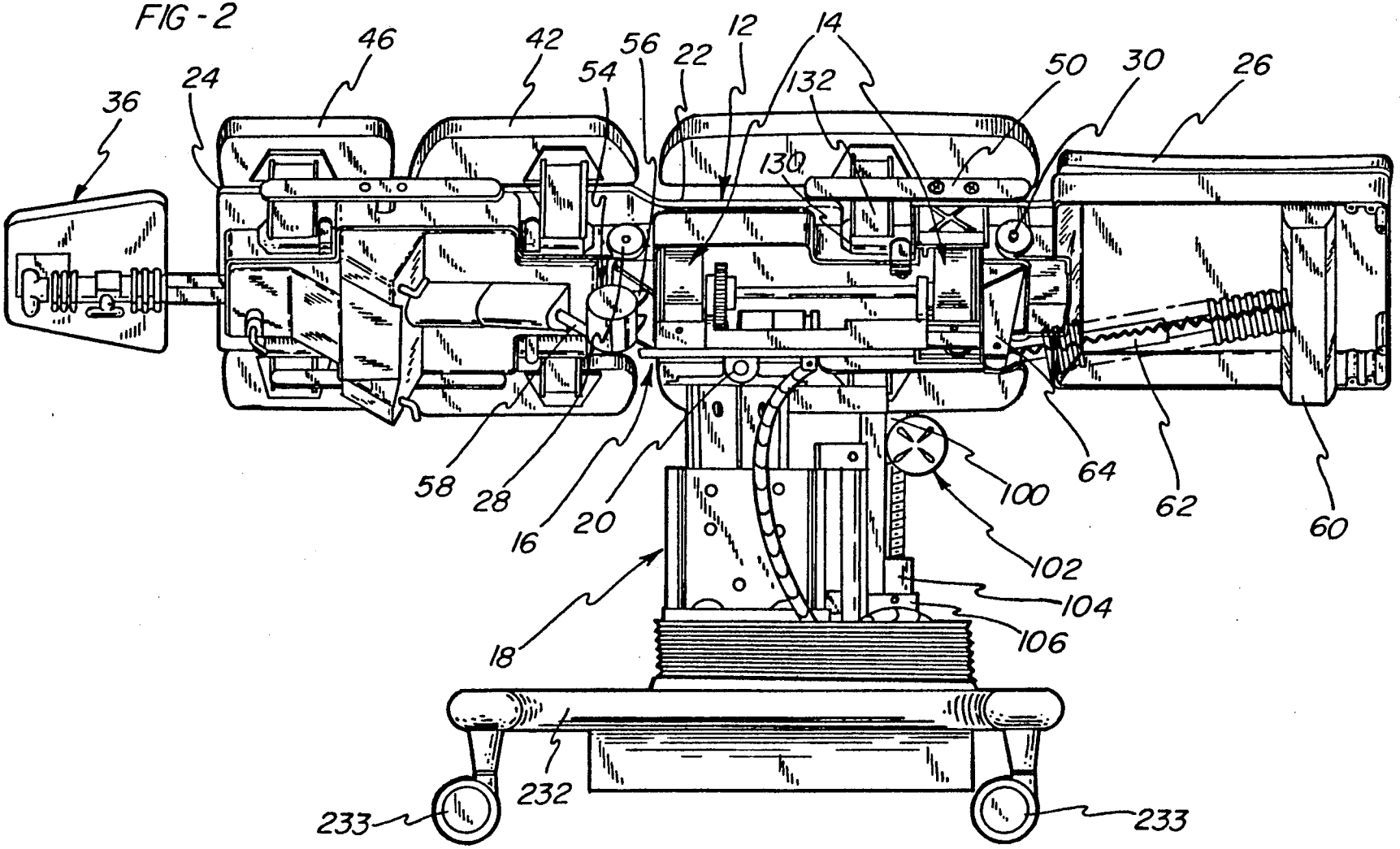
FIG. 2 is a side elevational view of the table wherein the patient support portion is shown tilted to one side an exaggerated amount in order to allow the components under the table to be clearly seen.

Referring to FIGS. 1 and 2, the plastic surgery table 10 of the present invention includes a patient support portion 12, track means 14 rigidly attached to the support portion 12, a support base 16 and a base portion 18 wherein the support base 16 is attached to the base 18 at a pivot point 20.

The support portion 12 includes a first section 22 for supporting the trunk portion of a patient, a second section 24 for supporting a torso portion of a patient and a third section 26 for supporting the leg portion of a patient. The second and third sections 24, 26 are pivotally mounted to the first section 22 at pivot points 28 and 30, respectively. The patient support portion 12 is designed such that it may receive a patient in a supine position and includes an elongated dimension defining a longitudinal axis 32 and a lesser width dimension defining a lateral axis 34.

Further, a headrest assembly 36 is provided at a longitudinal end of the table 10 adjacent to the second section 24, and lateral support wings or side pads 38, 40, 42, 44, 46, 48 are provided along the lateral sides of the first and second sections 22, 24. Also, opposing pairs of accessory support rails 50 and 52 are provided adjacent to the lateral sides of the first and second sections 22, 24 for supporting various accessories which may be used during surgery.

Referring to FIG. 2 a motor driven linear actuator 54 having a screw drive mechanism pivotally mounted to a support bracket 56 formed integrally with and extending from the first section 22. A telescoping rod portion 58 of the actuator 54 is attached to the back of the back of the second section 24 (see also FIG. 6). Similarly, a motor driven actuator 60 having a screw drive mechanism mounted to a lower portion of the third section 26 and includes an actuation rod 62 attached to a bracket 64 on the first section 22. Thus, operation of the actuators 54 and 60 results in pivotal movement of the respective second and third sections 24, 26 about the pivot points 28, 30 relative to the first section 22 whereby the patient's torso and legs may be positioned at a convenient location depending on the needs of the particular operation being performed.

Figure 3:
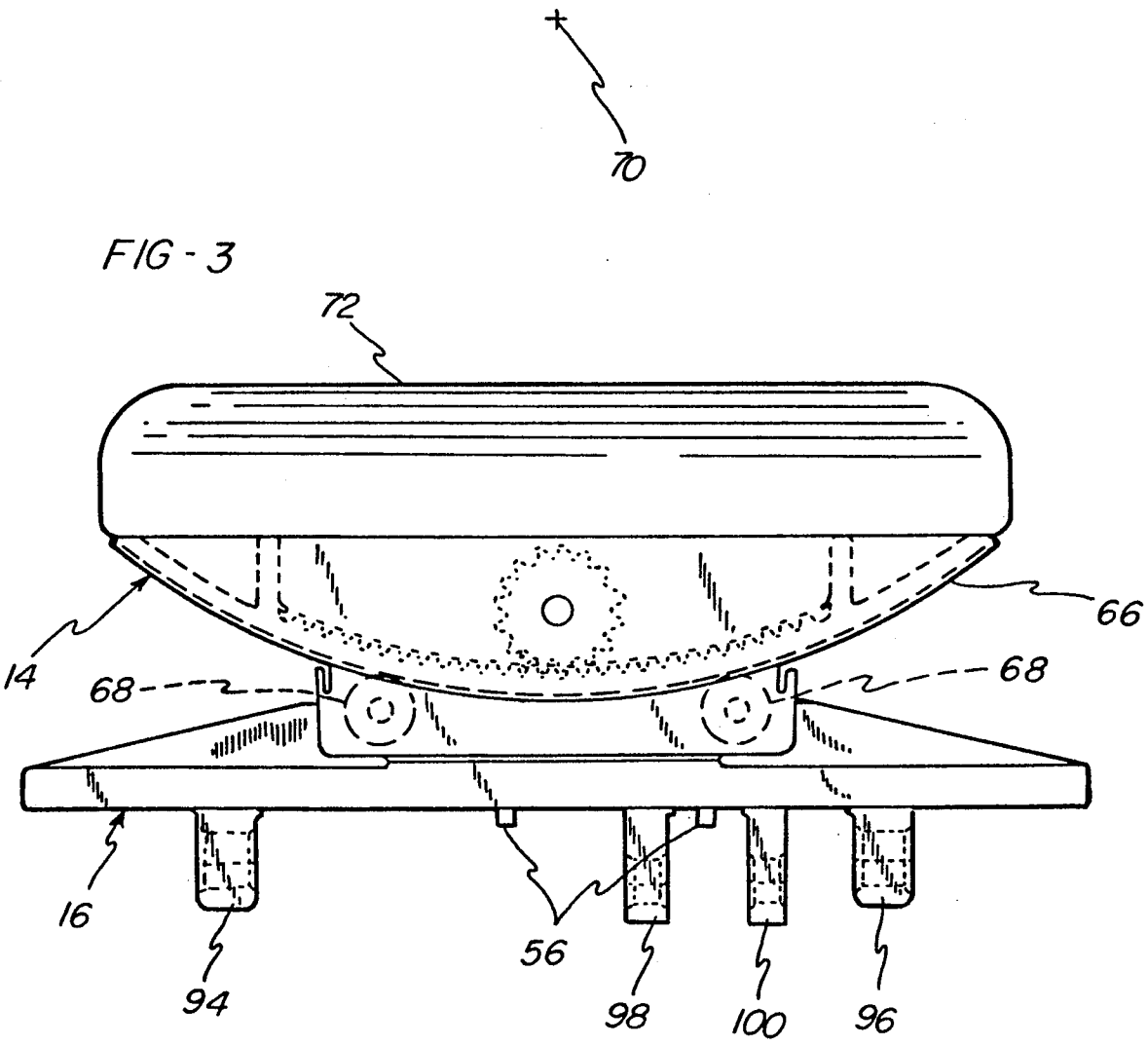
FIG. 3 is an elevational view taken from the foot end of the support base for mounting the patent support portion to the base and showing the bearing and track portion for guiding the table in tilting movement.
Figure 4:
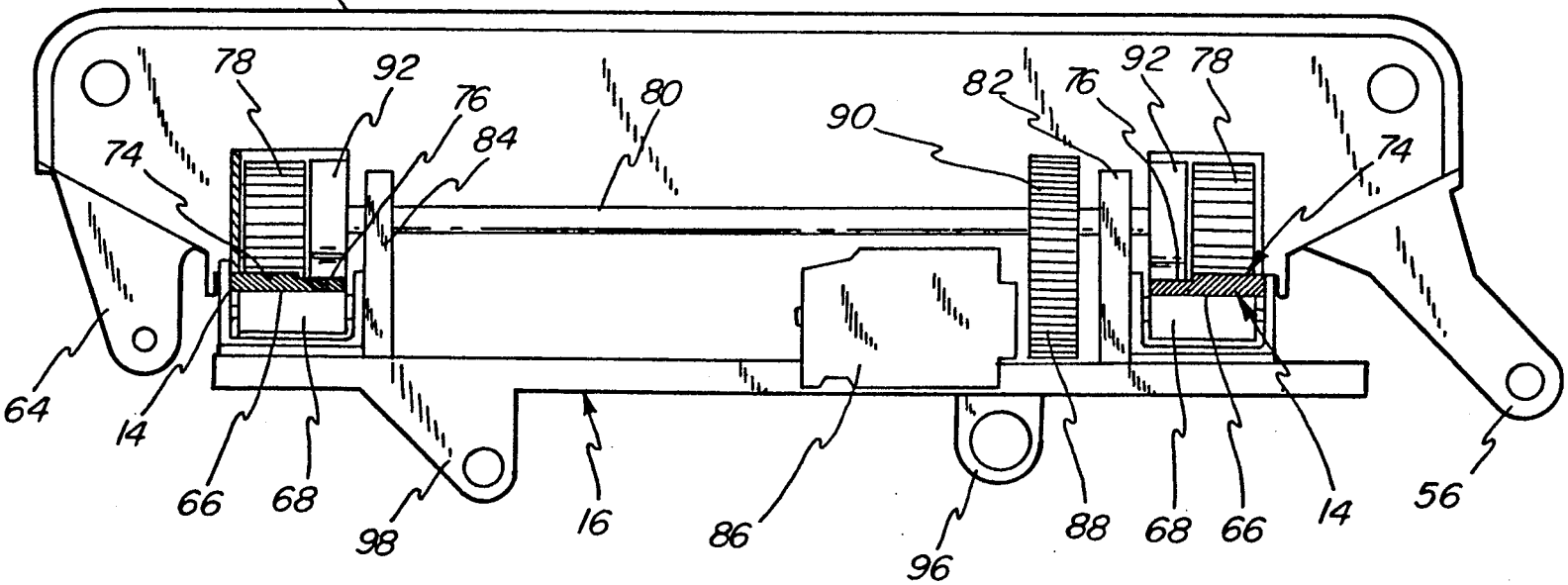
FIG. 4 is a side elevational view in partial cross-section showing the elements illustrated in FIG. 3.

Referring to FIGS. 2–4, the patient support portion 12 is mounted for tilting or rotational movement about an axis extending parallel to the longitudinal axis 32. As may be seen in FIG. 3, the track means 14 includes a smooth outer surface 66 supported on bearing rollers 68 which are rotatably mounted to the support base 16. Further, the track means 14 are formed with an arcuate shape defining a pivot axis 70 located above the upper surface of the first section 22. In the preferred embodiment, the radius of curvature of the track means 14 is approximately 9 inches and the pivot axis 70 is approximately 4.75 inches above a top surface of a frame portion 72 of the section 22 or 2.75 inches above a 2 inch thick cushion supported on the frame portion 72. Thus, the axis 70 will pass through a longitudinal center line of a patient lying on the support portion 12.

As may be seen in FIG. 4, the frame portion 72 rigidly mounts the track means 14 at opposing longitudinal ends of the first section 22 wherein each of the track means 14 is supported by a pair of rollers 68. The track means 14 each include a toothed section 74 and a smooth section 76 running parallel to the toothed section 74. A drive gear 78 is located in association with each of the toothed sections 74 and the drive gears 78 are mounted on opposing ends of a drive shaft 80. The drive shaft 80 is mounted for rotation on support extensions 82, 84 which are rigidly located on the support base 16. A motor 86 is also mounted to the support base 16 and includes a drive shaft carrying a gear 88. The gear 88 engages a gear 90 positioned on the drive shaft 80 such that the drive shaft 80 is rotated via the gears 88 and 90.

Thus, the motor 86 operates to drive the gears 78 and move the track means 14 relative to the support base 16. The toothed sections 74 extend a sufficient distance along the track means to permit the patient support portion 12 to be pivoted approximately 17½° from the horizontal in either direction for a total range of pivotal movement equal to about 35°.

In addition, the drive shaft 80 carries a bearing wheel 92 at either end thereof adjacent to the gears 78. The bearing wheels 92 engage the smooth inner surface 76 of the track means 14 to thereby maintain the outer surface 66 of the track means 14 in constant engagement with the rollers 68 as well as to facilitate positioning the gears 78 in relation to their respective toothed sections 74.

By providing a pivot axis 70 which is located above the table surface and which also preferably passes through a patient lying on the table surface, the rotation occurs about a fixed pivot point substantially located at the patient's centerline such that the patient is not moved side to side during the rotation. Thus, the patient does not experience any discomforting lateral forces but rather is moved in a stable manner about an axis passing through the patient.

In addition, since the patent is not moved laterally during rotation about the axis 70, the access of the surgeon to the patient is not adversely affected as is the case with various prior art surgery tables in which pivoting of the patient is accompanied with a lateral movement of the patient support surface away from the central axis of the table.

As may be seen in FIG. 3, the support base 16 is provided with a pair of downwardly extending legs 94, 96 for mounting the support base to the base portion 18 at the pivot points 20 (see FIG. 2). In addition, a further pair of legs 98, 100 are provided on the support base 16 for mounting a motor driven linear actuator 102 having a screw drive mechanism. A lower shaft receiving collar 104 for the actuator 102 is mounted to a bracket 106 which extends from and is rigidly attached to an upper part of the base portion 18. Thus, the actuator 102 may be operated to pivot the support base 16 about the pivot point 20 such that the pivot 20 forms a lateral pivot axis parallel to the lateral axis 34 of the support portion 12. It should also be apparent that as the support base 16 is pivoted, the patient support portion 12 of the table will also be pivoted about the lateral pivot axis such that the relative height between the ends of the patient support portion 12 may be adjusted.

It should be noted that during the tilting of the patient support portion 12 about the longitudinal tilt axis 70, the relative position between the first, second and third sections 22, 24, 26 remains unchanged while the track means 14 moves relative to the support base 16, and during the lateral pivoting motion of the patient support portion 12 about the lateral pivot axis defined by pivot point 20, the relative positions between the first, second and third sections 22, 24, 26, as well as the relative position between the track means 14 and the support base 16, remains unchanged.

Figure 5:
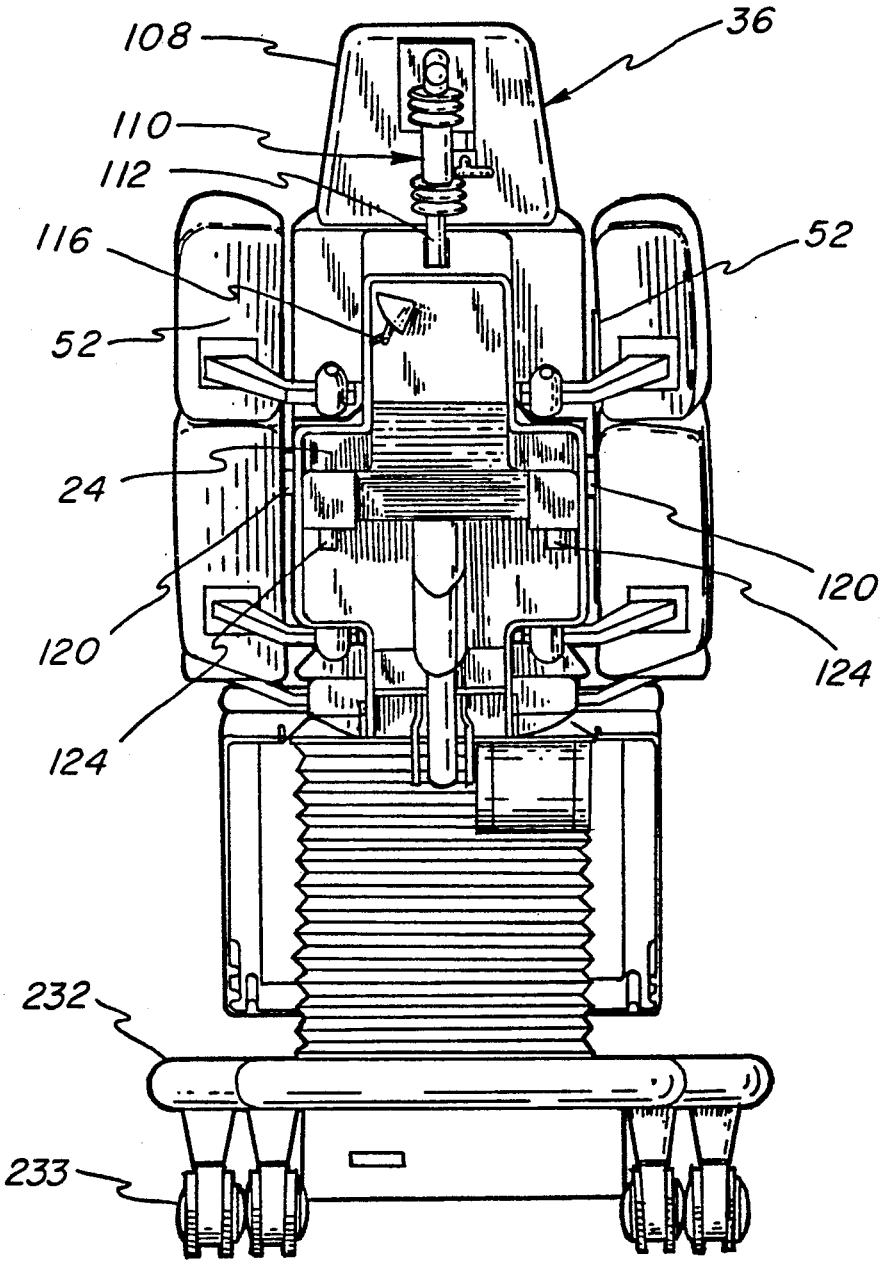
FIG. 5 is a rear elevational view of the table illustrating the attachment of the headrest to the patient supporting portion of the table.

Referring to FIG. 5, the headrest assembly 36 includes a pad portion 108 attached to an adjustment mechanism 110 which in turn is connected to a substantially square mounting post 112. The mounting post 112 passes into a mounting bracket 114 (see FIG. 6) which is located at the top edge of the second section 24. The shaft 112 is adjustable within the bracket 114 in a direction longitudinally aligned with the longitudinal axis 32 and a hand operable adjustment screw 116 is provided for engaging threads within a stem 118 attached to the bracket 114 whereby the shaft 112 may be locked in place relative to the bracket 114. The headrest pad 108 may also be positioned lying in a plurality of planes extending transversely to each other by means of the adjustment mechanism 110, which adjustment mechanism will be described further below.

Figure 6:
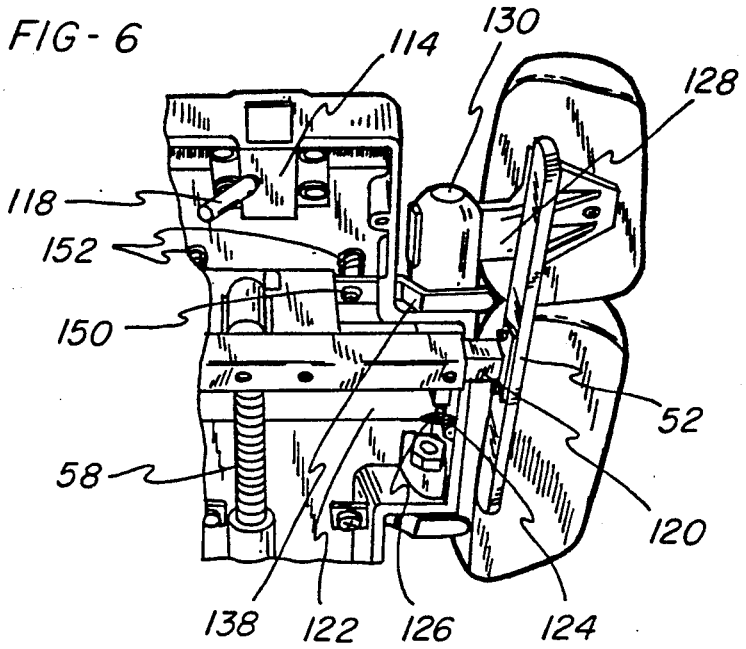
FIG. 6 shows an upper rear corner of the back of the table in which the headrest and back cover have been removed.

As may also be seen in FIGS. 5 and 6, the pair of accessory rails 52 are mounted to the second section 24 by means of substantially square posts 120 which are received within a square bracket tube 122. The posts 120 are received in sliding engagement within the tube 122 such that the lateral distance between the rails 52 and the sides of the second section 24 may be adjusted. The posts 120 may be locked in position by means of hand operable locking screws 124 which are received in threading engagement within stems 126, which stems 126 are rigidly attached to the tube 122.

The variable positioning of the rails 52 is important in the present invention in that during certain operations, such as facial reconstruction, it is important for the doctor or other personnel to be able to be positioned as close as possible to the side of the patient in which case the pads 46 and 52 may be removed from the second section 24 and the accessory rail 52 would be slid into close proximity to the side of the second section 24. During other operations, where the side pads 46 and 52 are in position adjacent to the side of the second section 24, the rails 52 may be extended laterally outwardly beyond the pads 46, 52 to support accessories such as IV supplies.

Figure 7:
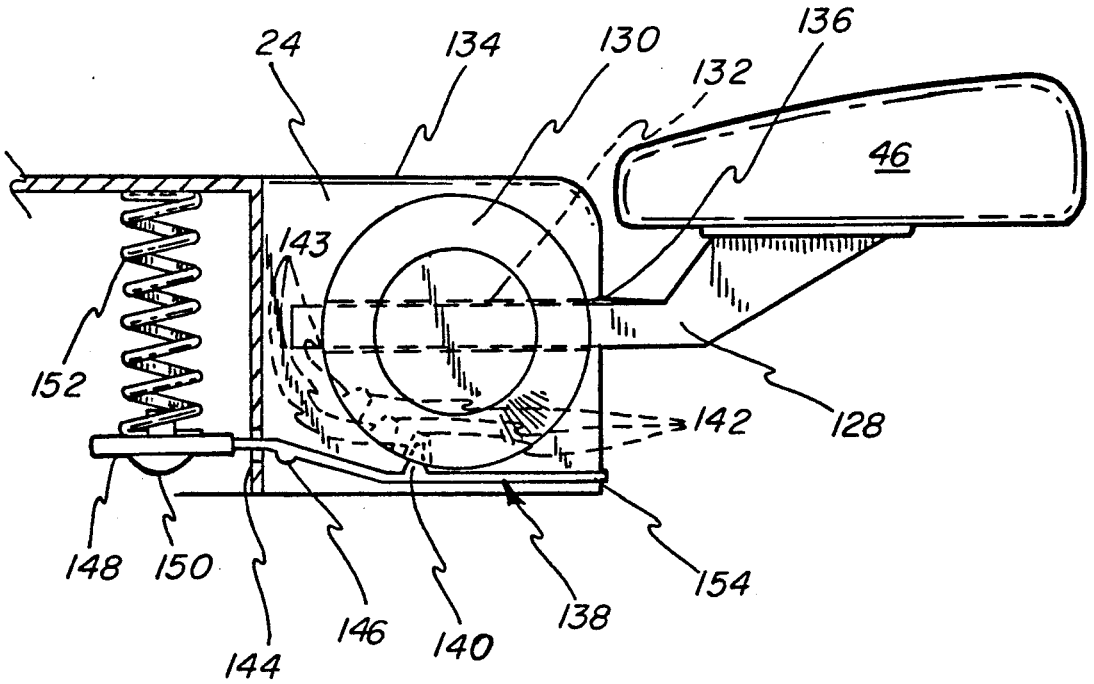
FIG. 7 is an end view illustrating the locking mechanism for positioning the pivoting knobs that mount the lateral support pads.

Referring to FIG. 7, the mechanism for permitting the side pads to be removed from the table 10 is shown, as well as a locking mechanism for allowing the pads to be pivoted upwardly. Although the side pads may vary in size and shape, the mounting and locking mechanism for these pads is essentially the same and FIG. 7 depicts the mounting and locking mechanism for the pad 46 shown in FIG. 6. The pad 46 is attached to a wing arm 128 which is received within a pivot knob 130. The pivot knob 130 is rotatably mounted to its respective patient support section 24 such that the pad 46 may be pivoted upwardly from a position substantially parallel to the upper surface of the section 24.

The arm 128 is received within an elongated aperture 132 formed in the pivot knob 130 and the arm 128 includes a protrusion or detent 134 extending from the upper surface adjacent to the end thereof. The distance from the bottom surface of the arm 128 to the top of the protrusion 134 is slightly less than the size of the aperture 132 such that the end of the arm 128 may slide through the aperture 132 and the arm 128 is provided when an area 136 which is intended to be positioned adjacent to the laterally outer edge of the pivot knob 130 and which has a thickness greater than the opening of the aperture 132.

During normal use, the weight of the pad 46 will pivot the arm 128 slightly within the aperture 132 such that the detent 134 is moved upwardly and will be positioned to engage an edge of the knob 130 adjacent to the aperture 132 whereby the arm 128 is prevented from sliding laterally out of the knob 130. However, when it is necessary to remove the pad 46, the pad and arm 128 may be lifted such that the detent 134 is moved downwardly to clear the aperture 132, at which time the arm 128 may be moved laterally outwardly to detach the pad 46 from the pivot knob 130.

The mechanism for locking the pivot knob 130 against pivotal movement includes a pivot lever 138 having a paw 140 for engaging within indentations or grooves 142 formed around the circumference of the pivot knob 130. It should be noted that the grooves 142 are formed with a ramp area 143 such that when the pawl 140 is forced into the grooves 142, the knob 130 may still be rotated to pivot the pad 46 upwardly. However, movement of the pad 46 in a downward direction will be resisted.

A pivot point for the lever 138 is formed at an aperture 144 defined in the side of the second section 24. A detent 146 is provided on the lever 138 to prevent inward movement of the lever 138 through the aperture 144 and a plate 148 is held in position on the end of the lever 138 by means of a fastener 150 to thereby limit outward movement of the lever 138 through the aperture 144. In addition, a compression spring 152 is located between an interior surface of the section 24 and the end of the lever 138 and is held in place by the end of the fastener 150. Thus, the spring 152 acts to pivot the lever 138 about a pivot point formed at the aperture 144 such that the pawl 140 is biased into one of the grooves 142 formed in the pivot knob 130. When it is desired to pivot the pad 46 downwardly, the outer end 154 of the lever 138 may be pressed manually downwardly to disengage the pawl 140 from the knob 130 and when it is desired to move the pad 46 upwardly, it is only necessary to pull upwardly on the pad 46 since the pawl 140 will rise on the ramp surfaces 143 formed in the grooves 142 and will sequentially drop into the grooves 142 as the pad 46 is pivoted upwardly.

In the preferred embodiment, the pads may be pivoted upwardly at least 45°. It should be noted that the pads 38, 40, 42, 44, 46, 48 are useful during the tilting of the patient support portion 12 about the longitudinal pivot axis 70 and act to provide lateral support for the patient during such pivoting motion as well as acting to provide continuing side support while the support portion 12 is held in such a tilted position.

Figure 8:
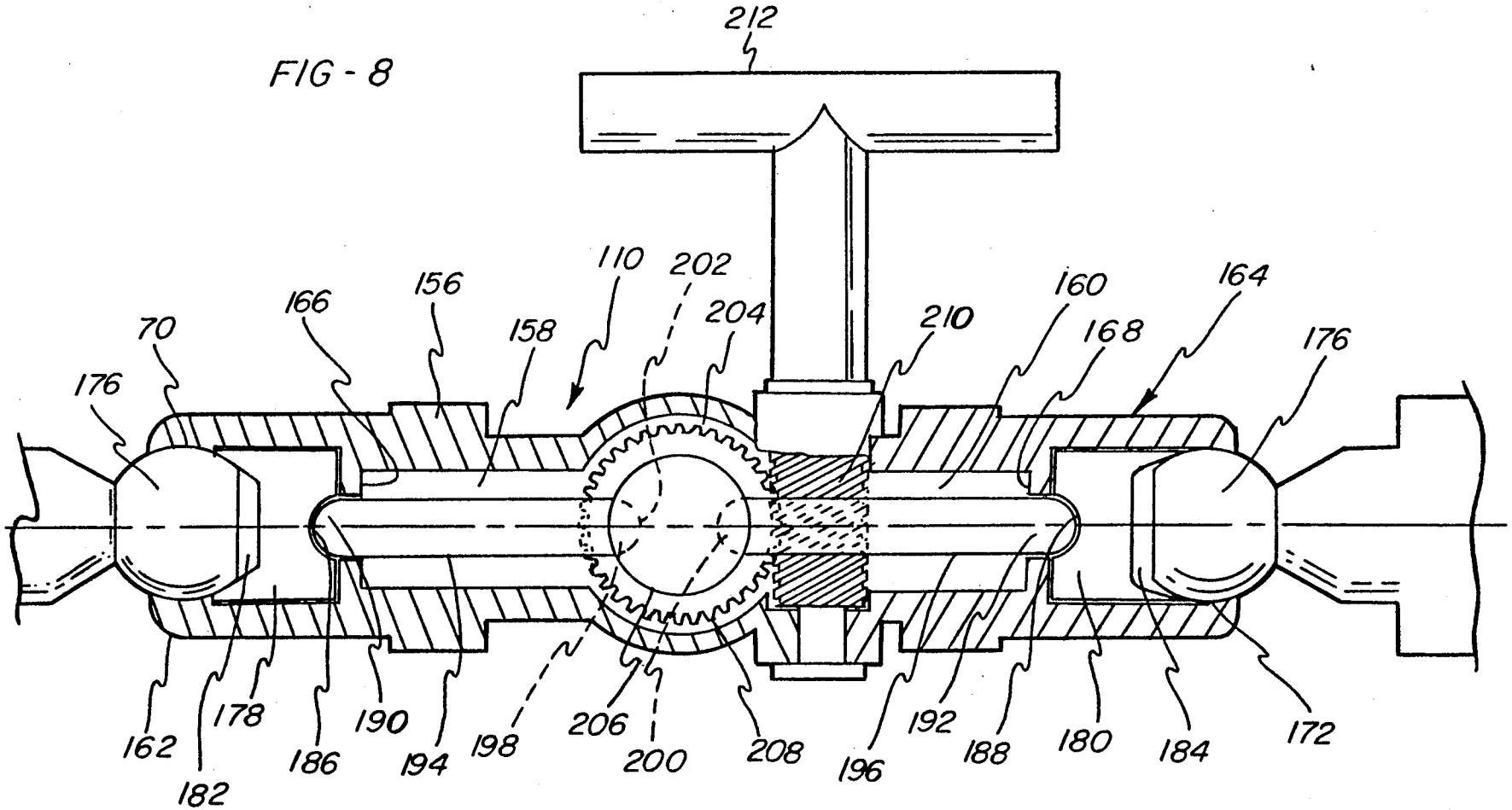
FIG. 8 shows the locking mechanism for the headrest in a locked positioned and in which the housing is shown in partial cross-section.
Figure 9:
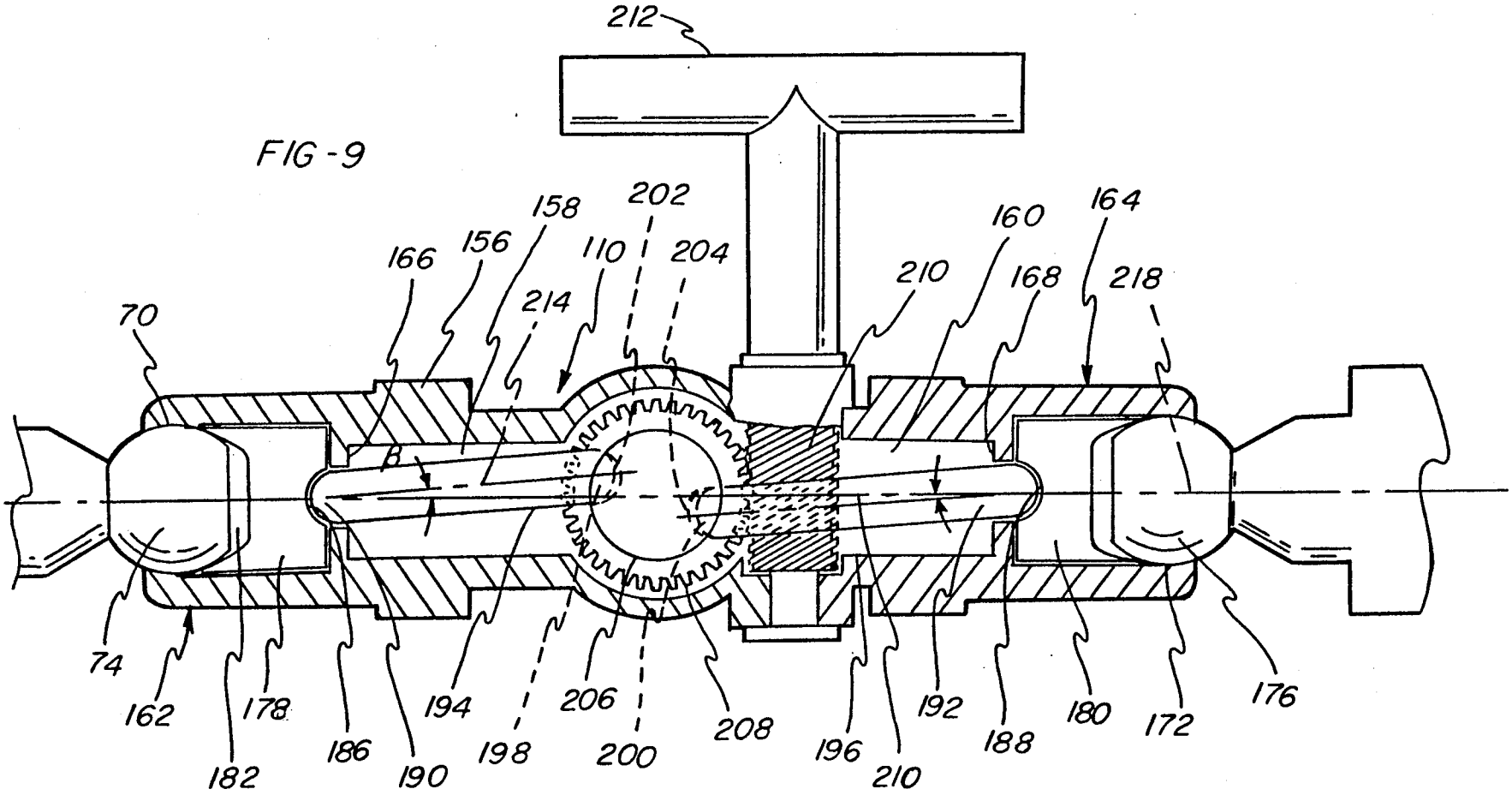
FIG. 9 is a view similar to FIG. 8 in which the locking mechanism is shown in an unlocked positioned.

Referring to FIGS. 8 and 9, the adjustment mechanism 110 for the headrest assembly 36 includes an adjustment housing 156 including means forming elongated apertures 158, 160. First and second ball and socket assemblies 162, 164 are located adjacent to the ends 166, 168 of the apertures 158, 160. The ball and socket assemblies 162, 164 include socket portions 170, 172 which are dimensioned to contact and retain respective ball portions 174, 176 therein. The ball portions 174, 176 are adapted to pivot and rotate to a variety of positions within the socket portions 170, 172, and the socket portions 170, 172 include means defining apertures for the ball portions 174, 176 to pass through to a point exterior of the adjustment mechanism 110.

The assemblies 162, 164 further include socket cylinders 178, 180 located within the socket portions 170, 172 and including cup shaped portions 182, 184 for engaging an end surface of respective ball portions 174, 176. It should be noted that the interior surfaces of the socket portions 170, 172 and the surfaces of the cup portions 182, 184 which contact the ball portions 174, 176 substantially conform to the shape and contours of the ball portions 174, 176 such that the cylinders 178, 180 will effectively lock the ball portions 174, 176 against movement relative to the housing 156 when the cylinders 178, 180 are pressed outwardly into engagement with the ball portions 174, 176.

The cylinders 178, 180 include semi-spherical indentations 186,188 opposite from the cup shaped portions 182, 184. The indentations 186,188 each receive a first end 190, 192 of a respective rod 194, 196.

The rods 194, 196 extend through the respective elongated apertures 158, 160 and include second ends 198, 200 positioned within semi-spherical indentations 202, 204 formed in a cylindrical rod actuator shaft 206. A drive gear 208 is rigidly attached to one end of the actuator shaft 206 and the shaft 206 and gear 208 are mounted for rotation within the housing 156 adjacent to the inner ends of the elongated apertures 158, 160.

A worm gear 210 is mounted for rotation within the housing 156 and is positioned in contact with the drive gear 208 such that rotation of the worm gear 210 causes rotation of the drive gear 208. A handle 212 is rigidly attached to the worm gear 210 and the handle 212 may be used to manually rotate the worm gear 210.

Referring to FIG. 9, it may be seen that rotation of the shaft 206 causes the second ends 198, 200 of the rods 194, 196 to pivot about a pivot point formed at the contact between the first ends 190, 192 and the indentations 186,188, respectively, such that an angle $\beta$ is formed between a longitudinal axis 218 of the housing 156 and the longitudinal axes 214, 216 of each of the rods 194, 196. As the angle $\beta$ is increased, such as when the shaft 206 is rotated from the position of FIG. 8 to the position of FIG. 9, the force applied by the rods 194, 196 against the cylinders 178, 180 is decreased such that the ball portions 174, 176 will be free to pivot relative to the sockets 170, 172.

It should be noted that the relative positions shown in FIGS. 8 and 9 are exaggerated for illustrative purposes and typically only a very small rotation of the shaft 206 is required to move the rods 194, 196 from a locked to an unlocked position. Further, the rods 194, 196 will typically not move completely to the position of direct alignment with the axis 218 since this may result in the second rod ends 198, 200 passing over center causing the force on the rods to be released. However, the general principle illustrated in FIGS. 8 and 9 is that as the angle $\beta$ is decreased through rotation of the shaft 206, the force applied to the cylinders 178, 180 is increase to thereby lock the ball portions 174, 176 against movement.

By providing a worm gear 210 to drive the gear 208, a high torque force may be applied to turn the shaft 206 whereby a large force may be applied through the rods 194, 196 without a great deal of exertion having to be applied through the handle 212. This is important since the operator may easily maintain the head pad 108 in position while turning the handle 212 without applying high torquing forces which would tend to move the housing 156 out of position.

It should be noted that the ball socket 174 is attached to the headrest pad 108 through a headrest post 220 (see FIG. 2) and the ball portion 176 is attached to the post 112 such that the two ball and socket assemblies 162, 164 provide a wide variety of adjustments between the shaft 112 and the post 220.

Figure 10:
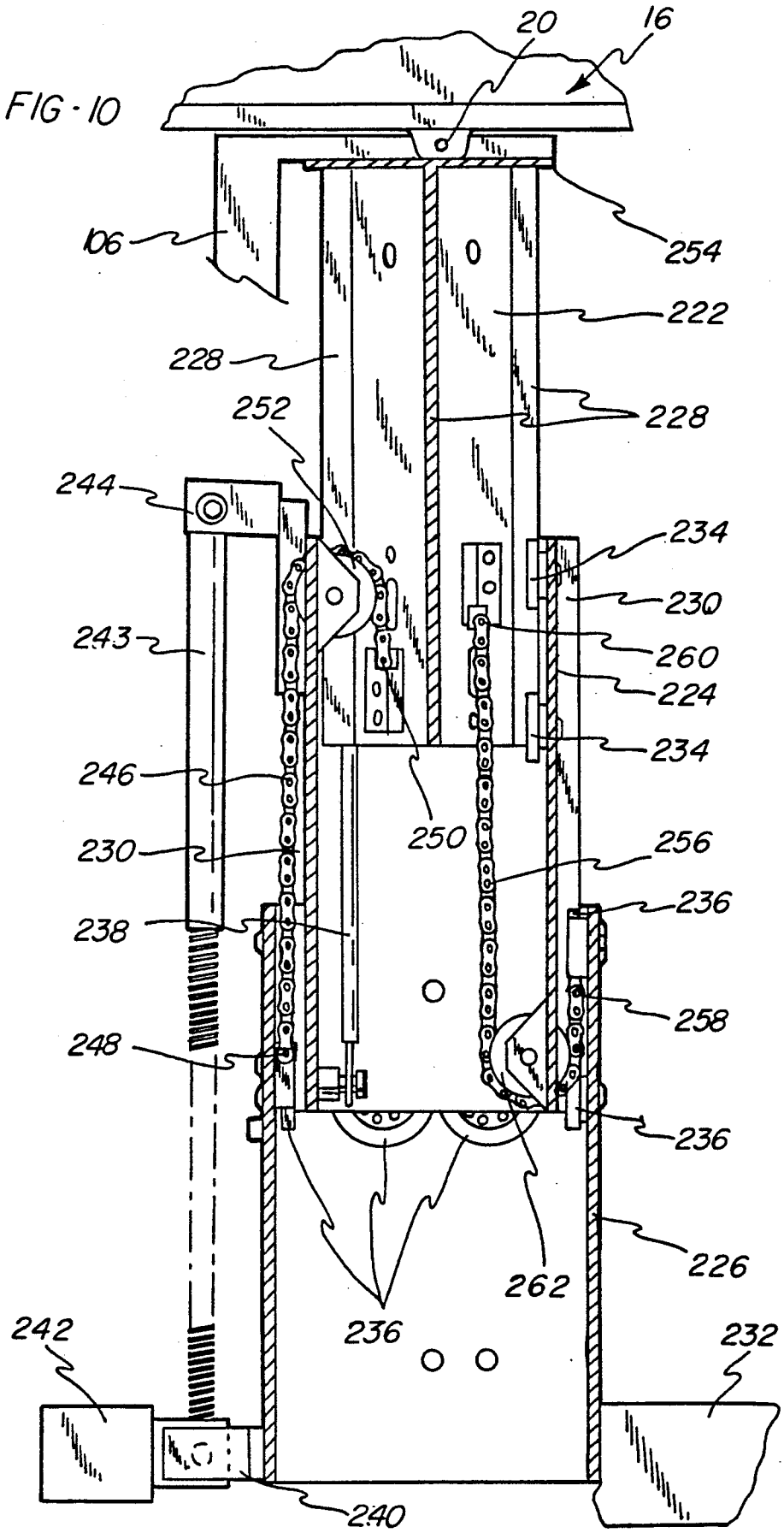
FIG. 10 is a cross-sectional elevational view from the left side showing the base post members for varying the height of the table.

Referring to FIG. 10, details of the base portion 18 are shown including a pedestal structure for supporting the support portion 12 at various heights. The base portion 18 includes a first post member 222, a second post member 224 and a third post member 226, wherein the first post member 222 is received in telescoping relationship within the second post member 224 and the second post member 224 is received in telescoping relationship within the third post member 226. The post members 222, 224, 226 are each formed having a substantially square cross-section, and the first and second post members 222, 224 are preferably formed having laterally extending rib portions 228, 230 to facilitate guiding the first and second post members 222, 224 in movement relative to each other and relative to the third post member 226. Further, it should be noted that the third post member 226, is rigidly mounted to a platform portion 232 of the base 18, as may be seen in FIGS. 1 and 2. The platform portion 232 is provided with a plurality of wheels 233 for supporting the table on a floor surface.

As seen in FIG. 10, the ribs 228 of the first post member 222 are engaged by bearing wheels 234 mounted for rotation on the second post member 224 whereby the first post member 222 is guided in its vertical movement relative to the second post member 224.

Similarly, the ribs 230 on the second post member 224 are engaged by bearing wheels 236 mounted for rotation on the third post member 226 whereby the bearing wheels 236 guide the second post member 224 in vertical movement relative to the third post member 226.

A gas cylinder 238 is positioned with opposing ends connected to the second post member 224 and the first post member 222 to provide a constant upward biasing force to the first post member 222 relative to the second post member 224.

The third post member 226 includes a laterally extending bracket 240 at a lower portion thereof for mounting a motor driven linear actuator 242 having a screw drive mechanism. The end 243 of the actuator 242 opposite from the bracket 240 is attached to an upper bracket 244 which is mounted to the second post member 224. Thus, upon operation of the actuator 242 the second post member 224 will move relative to the third post member 226 in direct relation to the movement of the actuator end 243.

A first chain 246 is provided having a first end 248 attached to the interior of the third post member 226 and having a second end 250 attached to a lower portion of the first post member 222. The chain 246 extends over a pulley wheel 252 which is mounted adjacent to the upper edge of the second post member 224. Thus, when the second post member 224 is moved upwardly, the pulley wheel 252 will draw the chain 246 upwardly which in turn will cause the first post member 222 to move vertically upwardly. It should be noted that the first post member 222 will move upwardly at a rate twice as great as the rate of movement of the second post member 224 resulting in the upper edge 254 of the first post member 222 moving a distance twice as great as the upward movement of the actuator end 243. It should also be noted that the upper edge 254 carries the pivotal connection 20, as well as the attachment point for the bracket 106.

A second chain 256 is provided having a first end 258 attached to an upper portion of the interior wall of the third post member 256 and having a second end 260 attached to the first post member 222. The chain 256 extends under a pulley wheel 262 mounted to a lower edge of the second post member 224 such that downward movement of the second post member 224 will draw the second end 260 of the chain 256 downwardly to pull the first post member 222 downwardly. The second chain 256 is needed in order to insure that the first post member 222 will move downwardly against the upward biasing force of the gas cylinder 238 when the actuator acts to draw the second post member 224 downwardly.

The above described lift mechanism is particularly useful for surgery tables which are used in plastic surgery operations since the table must be low enough for the patient to mount the table prior to the operation and subsequently the table must be at a higher elevation in order to permit the surgeon conveniently operate on the patient. The present lift mechanism varies the height of the upper surface of the table from 24 inches to 42 inches such that a wide variation in table height is obtained by the present compact telescoping lift structure. This may be compared with typical currently available operating tables which have a minimum height of approximately 29 inches, which height has proven to be an obstacle in mounting such tables.

Further, the low mounting height of the present invention has also been obtained by providing a compact mechanism for providing the tilting motion about the longitudinal axis. By providing the gearing for effecting this tilt enclosed within the frame structure of the patient supporting portion, the drive mechanism for causing the tilting motion adds a minimum of additional height to the table.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. A surgery table for supporting a patient in a plurality of positions, said table comprising:

a patient support defining a longitudinal axis extending along an elongated dimension of said table and a lateral axis extending along a width dimension of said table, said patient support including at least a central portion longitudinally spaced from opposing longitudinal ends of said patient support for supporting a trunk portion of a patient, a pedestal structure located at said central portion for supporting said patient support, a support base including an arcuate track cooperating with bearings to form a support connection between said patient support and said pedestal structure, said arcuate track defining a longitudinal pivot axis parallel to said longitudinal axis and located above said patient support, a support base pivot forming a connection between said support base and said pedestal located between said ends of said patient support under said central portion, said support base pivot defining a lateral pivot axis parallel to said lateral axis whereby said patient support is guided in pivotal movement about said lateral pivot axis.

2. The table of claim 1, wherein said patient support includes a first section forming said central portion for supporting a trunk portion of a patient, a second section for supporting a torso portion of a patient, first pivot means mounting said second section to a longitudinal end of said first section for pivotal movement of said second section relative to said first section, a third section for supporting a leg portion of a patient, and second pivot means mounting said third section to a longitudinal end of said first section for pivotal movement of said third section relative to said first section.

3. The table of claim 2, including first and second linear actuators driven by motors for moving said second and third sections relative to said first section.

4. The table of claim 2, wherein said support base is located between said first and second pivot means such that said first section of said patient support overlies said support connection and said support base pivot.

5. The table of claim 1, wherein said arcuate track includes inner and outer track portions, said inner track portion including tooth means and said outer track portion being smooth, said bearings including rollers for engaging said outer track portion, and gear means operatively connected to a motor, said gear means engaging said tooth means for moving said track relative to said pedestal structure.

6. The table of claim 5, wherein said track includes first and second inner and outer track portions located in longitudinally spaced relation to each other and said gear means includes first and second gears connected by a shaft extending parallel to said longitudinal axis.

7. The table of claim 1, wherein said pedestal includes height adjusting means for varying the height of said patient support relative to the floor.

8. The table of claim 7, wherein said height adjusting means includes first, second and third post members positioned in telescoping relation to each other, said first post member being located within and movable relative to said second post member, said second post member being located within and movable relative to said third post member and said patient support being mounted to and movable with said first post member.

9. The table of claim 8, wherein said pedestal includes a platform and said third post member is mounted to said platform, and a motor driven linear actuator is provided connected between said third post member and said second post member wherein operation of said actuator simultaneously causes movement of said second post member relative to said third post member and movement of said first post member relative to said second post member.

10. The table of claim 1, including side pads and pivot knobs mounted for rotation on lateral sides of said patient support, and including locking means, each locking means having a pawl portion and said pivot knobs including means defining a plurality of indent portions for receiving said pawl portion whereby said pivot knobs may be locked in a plurality of predetermined positions.

11. The table of claim 10, including accessory support rails supported at lateral sides of said patient support, said support rails being mounted for movement parallel to said lateral axis of said table toward and away from said patient support whereby said rails are movable to a position beneath said side pads.

12. The table of claim 1, including a headrest attached to a longitudinal end of said patient support, said headrest including a mounting shaft mounted at a rear side of said patient support and movable along said longitudinal axis.

13. The table of claim 12, including a headrest pivot for mounting said headrest to said mounting shaft and permitting said headrest to be pivoted relative to said mounting shaft to be positioned in a plurality of planes oriented transversely to each other.

14. A headrest for use in combination with a patient support, said headrest comprising:

a head support portion for supporting the head of a patient, an adjustment housing including means defining an elongated aperture, said elongated aperture defining a central longitudinal axis of said adjustment housing, ball and socket means located on said adjustment housing at an end of said elongated aperture and connecting said head support portion to said adjustment housing such that said head support portion is mounted for pivotal movement relative to said adjustment housing, an elongated rod having opposing first and second ends, said first end of said rod engaging said ball and socket means, a rod actuator located at an end of said elongated aperture opposite from said ball and socket means and mounted for movement relative to said adjustment housing, and engagement means formed on said rod actuator for engaging said second end of said rod at a connection point, said connection point and said second rod end being movable together toward and away from said central longitudinal axis to lock said head support portion against movement and permit movement, respectively, of said head support portion relative to said adjustment housing.

15. The headrest of claim 14, wherein said rod defines a rod axis and an angle $\beta$ is defined between said central longitudinal axis and said rod axis with the apex of said angle $\beta$ located at said first rod end.

16. The headrest of claim 15, wherein movement of said rod actuator causes said angle $\beta$ to increase and decrease, and decreasing said angle $\beta$ results in said head support portion being locked against movement.

17. The headrest of claim 14, wherein said ball and socket means includes a socket portion attached to said adjustment housing and a ball portion attached to said head support portion, said socket portion including means defining an aperture therethrough, and said ball portion being retained within said socket portion and extending through said aperture in said socket portion.

18. The headrest of claim 14, wherein said rod actuator includes a shaft mounted for rotation about an axis perpendicular to said central longitudinal axis.

19. The headrest of claim 18, wherein said engagement means includes means defining an indentation in said shaft receiving said second end of said rod such that rotation of said shaft causes said first end of said rod to move toward and away from said ball and socket means whereby said headrest is locked and unlocked for movement, respectively.

20. The headrest of claim 18, including a drive gear mounted for rotation with said shaft and a worm gear engaged with said drive gear such that rotation of said worm gear causes rotation of said shaft.

21. The headrest of claim 18, including means defining a second elongated aperture in said adjustment housing, second ball and socket means located at an end of said second elongated aperture, a second elongated rod engaging said second ball and socket means and said shaft, and means attached to said second ball and socket means for mounting said headrest to said patient support.

22. A surgery table for supporting a patient in a plurality of positions, said table comprising:

a support portion for supporting a patient lying in a substantially supine position, a base portion including first, second and third post members positioned in telescoping relation to each other, said first post member being located within and movable relative to said second post member and said second post member being located within and movable relative to said third post member, said support portion being mounted to and movable with said first post member such that movement of said first and second post members causes the vertical positions of said support portion relative to the floor to be varied, and wherein an actuator is provided attached to said third post member and to said second post member wherein operation of said actuator simultaneously causes vertical movement of said second post member relative to said third post member and vertical movement of said first post member relative to said second post member.

23. The table of claim 22, including a flexible elongated drive member having first and second ends, said first end being attached to said third post member and said second end being attached to said first post member, said second post member including a bearing portion located at an upper edge thereof engaging said drive member such that upward movement of said second post member draws said elongated member upwardly to exert an upward force on said first post member.

24. The table of claim 23, including a second elongated drive member having first and second ends, said first end of said second drive member being attached to said third post member and said second end of said second drive member being attached to said first post member, said second post member including a second bearing portion located at a lower edge thereof engaging said second drive member such that downward movement of said second post member draws said second drive member downwardly to exert a downward force on said first post member.

25. The table of claim 22, including means connecting said first and second post members such that said first and second post members move simultaneously and said first post member moves at a rate which is twice as great as the rate of movement of said second post member.

26. A surgery table for supporting a patient, said table comprising:

a support portion for supporting a patient lying in a substantially supine position, said support portion including lateral edges and defining a longitudinal axis along a length of said table and a lateral axis along a width of said table, a side pad including a pad portion and support arm, a pivot knob located below said support portion adjacent to a lateral edge and mounted for rotation about a pivot axis parallel to said longitudinal axis, means defining an aperture through said pivot knob for receiving said support arm in sliding engagement in a direction substantially parallel to said lateral axis, and a detent member located on said support arm for engaging with a surface of said pivot knob to prevent movement of said support arm laterally outwardly from said aperture.

27. The table of claim 26, wherein said detent member engages an outer surface of said pivot knob adjacent to said aperture.

28. The table of claim 26, wherein a downward movement of said side pad relative to said pivot knob causes said detent member to be positioned in engagement with said surface of said pivot knob and an upward movement of said pad portion relative to said pivot knob causes said detent to move out of engagement with said surface of said pivot knob such that said support arm is movable out of said aperture.

29. The table of claim 26, including locking means, said locking means including a pawl and said pivot knob including means defining a plurality of indent portions for receiving said pawl whereby said pivot knob is locked in a plurality of predetermined positions.

* * * * *